US005906546A

United States Patent [19]

Albert

[11] Patent Number: 5,906,546

[45] Date of Patent: May 25, 1999

[54] BOWLING AID

[76] Inventor: David M. Albert, 8448 Colonial Dr., Littleton, Colo. 80124

[21] Appl. No.: 08/971,452

[22] Filed: Nov. 17, 1997

Related U.S. Application Data

[63] Continuation-in-part of application No. 08/571,094, Dec. 11, 1995, Pat. No. 5,688,181.

[51] Int. Cl.[6] ..... A63F 5/04

[52] U.S. Cl. ..... 473/61; 473/60; 2/21

[58] Field of Search ..... 473/55, 56, 59, 473/60, 61, 62, 63; 2/21, 161.3, 163, 161.1; 602/22; 401/7, 8; 294/25

[56] References Cited

U.S. PATENT DOCUMENTS

| | | | |
|---|---|---|---|
| 622,386 | 4/1899 | Peery | 2/21 |
| 1,220,007 | 3/1917 | Rowley | 294/25 |
| 2,225,571 | 12/1940 | Smith | 294/25 |
| 2,935,354 | 5/1960 | Chapman | 294/25 |
| 3,038,723 | 6/1962 | Bergendorf . | |
| 3,046,561 | 7/1962 | Marinese et al. . | |
| 3,091,455 | 5/1963 | De Mire . | |
| 3,098,654 | 7/1963 | Larsen . | |
| 3,224,012 | 12/1965 | Hamm . | |
| 3,248,112 | 4/1966 | Metzger | 473/61 |
| 3,362,027 | 1/1968 | Petrov . | |
| 3,398,951 | 8/1968 | Disko . | |
| 3,563,545 | 2/1971 | Rasche . | |
| 3,595,575 | 7/1971 | Gooch . | |
| 3,606,319 | 9/1971 | Borden . | |
| 4,194,736 | 3/1980 | Loafman . | |
| 4,273,330 | 6/1981 | Buneta . | |
| 4,371,163 | 2/1983 | Shaffer et al. . | |
| 4,466,313 | 8/1984 | Gardner | 294/25 |
| 4,608,720 | 9/1986 | Purin | 473/61 |
| 5,095,897 | 3/1992 | Clark et al. | 602/22 |
| 5,330,391 | 7/1994 | Mitchell . | |

OTHER PUBLICATIONS

Spare Time (advertisement); Bowling; vol. 32, No. 3 Oct. 1965 (p. 31).

"How to Improve Your Grip Game"; Good–Win Super Bowl Gripper (advertisement); Bowling; May, 1973 (p. 47).

Super Touch (advertisement); Bowling; Mar. 1980 (p. 9).

Kicker (advertisement); Bowling; Mar. 1984 (p. 30).

Kicker (advertisement); Bowling; Jun./Jul. 1984 (p. 39).

Power Plus (advertisement); Sports Tec; at least as early as Aug. 9, 1995.

Bobby's Axle (advertisement); at least as early as Aug. of 1995.

"Comfy Sleeve" Silicone Finger Sleeves, Red's Silicone Extrusions, Inc., 1725 Ocean Ave., Building #3 Raymond, Washington 98577, at least as early as Apr. 1995.

*Primary Examiner*—William M. Pierce
*Attorney, Agent, or Firm*—Holland & Hart LLP

[57] ABSTRACT

A bowling aid adapted to be mounted on either the bowler's index or little finger. The aid is a sheath into which the bowler's finger is inserted. Appropriate padding is provided in the sheath for gripping and protecting the finger. The padding can include a full-finger insert having removable serrated longitudinal sections. On the outer end of the sheath there is provided a plate which extends outwardly from the sheath under the head metacarpal joint of the bowler's index finger and part of the palm of the bowler's hand and is provided with a concave surface with a frictional coating thereon for assisting the bowler in gripping the bowling ball. The concave surface and friction coating extend along the length and width of the sheath. The bowler presses the plate and the length and width of the sheath against the surface of the ball to generate enhanced control during ball release. The sheath can define a gap along its length with a fastening system attached to the sheath to accommodate varying finger sizes.

27 Claims, 12 Drawing Sheets

FIG. 3
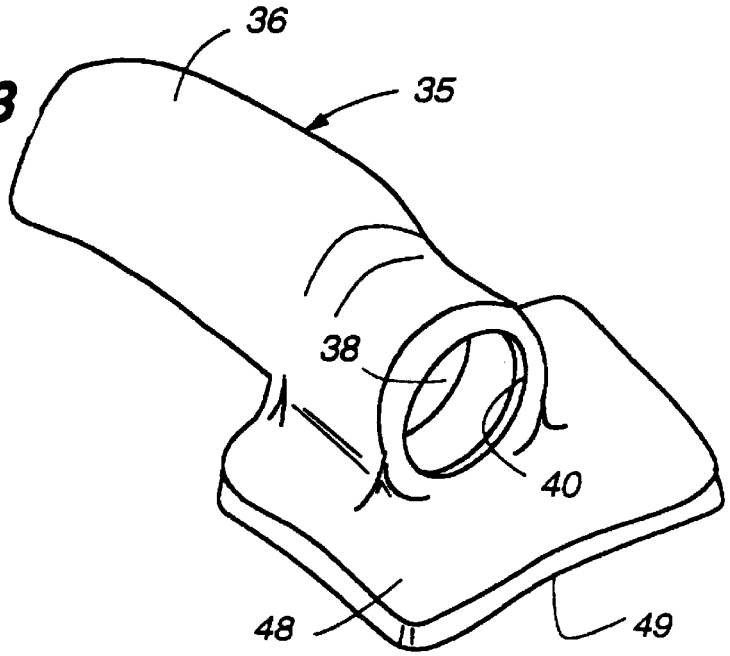
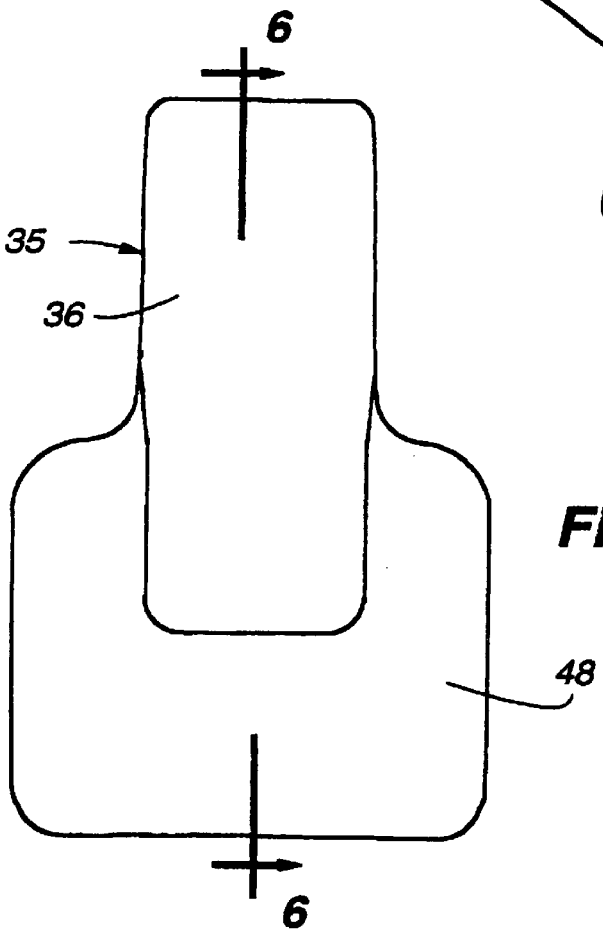
FIG. 4
FIG.5
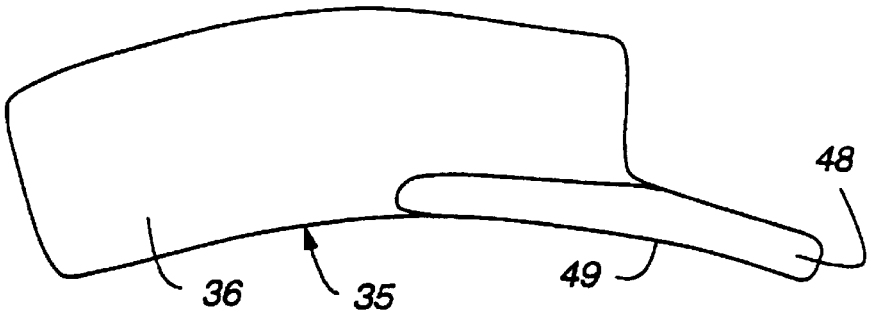

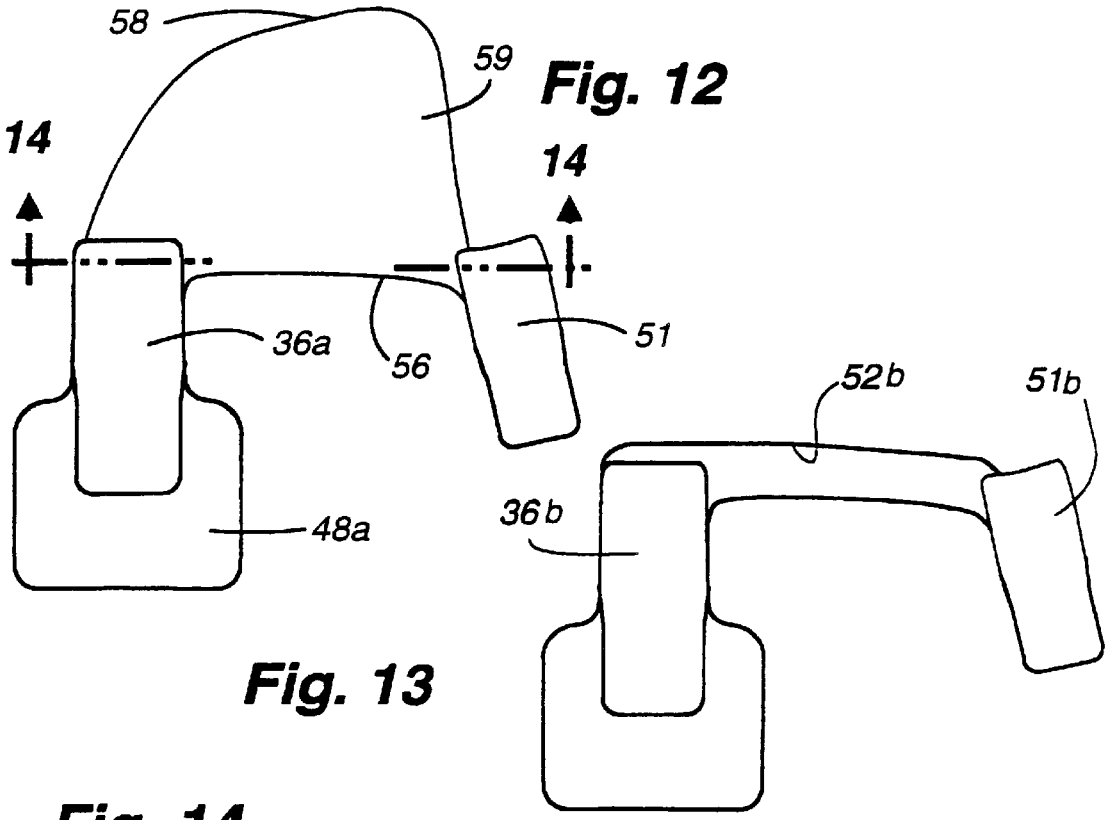
Fig. 12
Fig. 13
Fig. 14
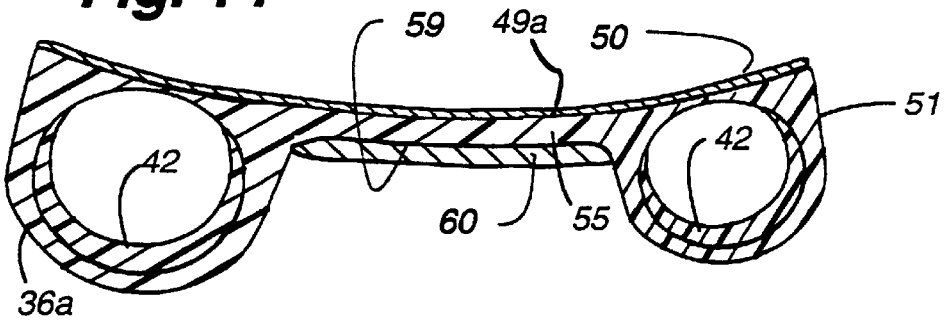
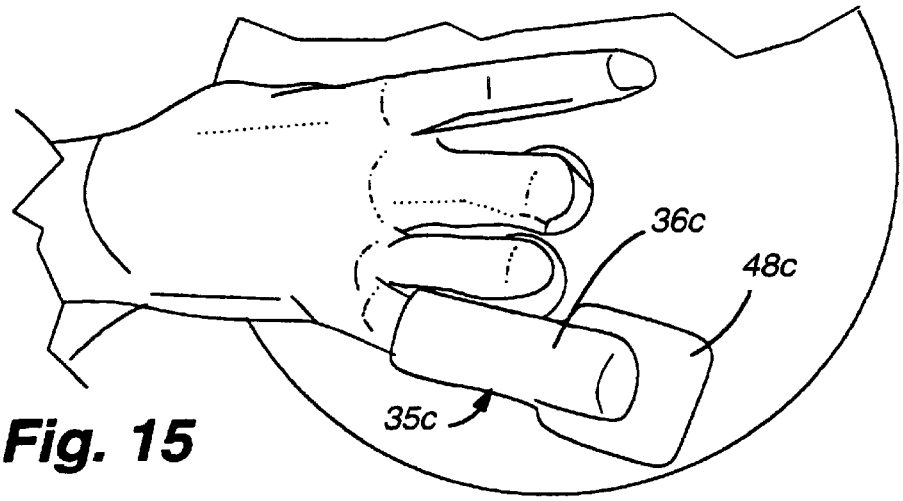
Fig. 15

BOWLING AID

CROSS REFERENCE TO RELATED APPLICATIONS

This application is a continuation-in-part of application Ser. No. 08/571,094 filed on Dec. 11, 1995, now U.S. Pat. No. 5,688,181.

BACKGROUND OF THE INVENTION

1. Field of the Invention

This invention relates to a bowling aid. More particularly, this invention relates to a bowling aid for use on a bowler's hand for controlling the bowling ball.

2. Description of the Prior Art

Bowling is a popular sport at both the leisure and competitive levels. In order to bowl at an intermediate or advanced level, the bowler must be able to swing and release the bowling ball with adequate lift, turn, axis rotation and axis tilt to produce the desired movement and rotation of the bowling ball as the ball travels down the bowling lane prior to striking the pins. The lift, turn, rotation, and tilt all combine to result in a specific path and movement so that the ball strikes the pins at the optimum position to produce the maximum pin count.

Lift is related to the time between when the bowler's thumb disengages from the bowling ball and when the bowler's fingers disengage from the bowling ball. Lift generates the revolution of the bowling ball, with high revolutions being desired. Stronger lift is developed by moving the hand behind and under the bowling ball during the release. This requires considerable strength in the fingers and the rest of the hand, especially the ring finger, which is substantially responsible for the lift generated in a bowling ball during release.

The track of the bowling ball is that portion of its surface contacting the lane as it is moving towards the pins. For present lane surface conditions, the ideal track is called a "semi-roller." This track is on the index finger side of bowling ball when the thumb and middle fingers are inserted into the grip holes. The track is adjacent to the thumb hole and middle finger gripping hole. The typical track has a length of about 10–12 inches around the bowling ball. Tracks of less than 10 inches are known as "spinner" tracks. They are typically indicative of a weak release, usually derived from minimal lift, early hand turn, or a late exiting thumb. These release variables can act alone or in combination to produce the spinner track. Spinner tracks have low revolution and a difficult time gripping the lane surface, and thus have very little energy when they strike the pins. The track has two axis points. In bowling jargon, the axis point on the small finger side of the hand with the bowler's thumb and two middle fingers inserted into the three gripping holes is termed the positive axis. The opposite axis is termed the negative axis.

During release, the positive axis is rotated by a right handed bowler in a counter clockwise direction. Proper axis rotation will result in the positive axis point centered and facing the bowler just after release. This process of axis rotation is effected through the "turn" which occurs during the release of the ball. The middle finger inserted into the bowling ball is substantially responsible for the "turn" generated during release. Turn is the second key ingredient of a proper release, the first being lift.

Both lift and turn occur after the thumb has exited the bowling ball during delivery. Adequate revolutions and axis rotation are not obtained without the proper amount of lift and turn. Inadequate lift and/or turn will reduce the strike power of the bowling ball. The index finger is particularly important in the stabilization of the bowling ball during release and leads the hand in the turning motion. Thus, bowlers with long fingers and strong hands have more potential to lift and turn the bowling ball properly during the release.

As the bowling ball moves down the lane, the positive axis begins to rotate towards the strike pocket. This movement of the axis is called axis tilt. If the bowling ball has been properly turned during the release to establish optimum axis rotation, the energy of the release will be retained long enough to allow the axis tilt to occur as the ball begins to grip the last one-third of lane surface in front of the bowling pins. The axis tilt continues as the ball strikes the pins. Inadequate axis rotation will result in inadequate axis tilt, and thus premature energy release. This produces a weak-hitting bowling ball since the energy of the bowling ball was released prior to striking the pins. In bowling jargon this is called a "roll out."

Bowling balls conventionally have three holes formed therein for receiving the bowler's thumb and middle fingers with the palm of the hand resting on the surface of the ball, and the index and little finger extending along the surface of the bowling ball. The insertion of the fingers into the holes allows the bowler to grip the ball adequately and hold the ball during the back swing and release thereof. The inserted fingers assist in generating the lift, turn, axis rotation, and axis tilt, as described above, necessary for controlling the movement of the bowling ball. The palm, index finger and little finger also contribute to the lift, axis rotation and axis tilt.

A person of normal strength often has a difficult time maximizing the lift, turn, axis rotation, and axis tilt of the bowling ball during release given the relatively small surface area of the index finger, little finger, and palm in contact with the outer surface of the bowling ball. As a result, the bowler's ability to develop into an advanced bowler is limited.

Various devices have been developed in an attempt to address the inherent limitation of the bowler's ability to generate the necessary lift, turn, axis rotation, and axis tilt. Some devices have emphasized improving the control of the bowling ball by the bowler's fingers by providing a flexible rubber finger cot which is placed on the finger. This device still only has a surface area in contact with the bowling ball similar in size to the surface area of a natural finger.

Other devices have attempted to improve the bowler's delivery of the bowling ball by spacing certain portions of the bowler's hand and fingers off of the bowling ball. These devices can lift the index finger and pull it off the ball, thereby decreasing the user's control of the ball and lessening the effectiveness of the finger to which it is applied. Still other devices have attempted to improve the bowler's performance by restricting the movement of the bowler's wrists. Locked wrist devices can inhibit the user's ability to generate optimum lift and turn during the release. The locked wrist devices can either produce an excess amount of lift with inadequate turn, or inadequate lift with excessive, early hand turn. In addition, they do not allow free wrist motion through the release.

A flexible sheath for the index finger, with a tacky surface for engagement with the surface of a bowling ball, is disclosed in "Bowling," June/July, 1984, at page 39. A glove with sheaths for the bowler's index and little fingers and a flexible strap tying the sheaths together, and non-slip surface for engagement with a bowling ball is shown in U.S. Pat. Nos. 3,595,575 and 3,224,012. A finger sheath formed of a flexible, resilient material for frictionally engaging a bowling ball is shown in U.S. Pat. No. 3,091,455.

Flexible covers for a bowler's index and little fingers are shown in U.S. Pat. No. 3,248,112. The covers have ribbed surfaces for frictionally engaging the bowling ball. A wrap-around sleeve and integral stiff tongue brace is shown in U.S. Pat. No. 4,194,736.

OBJECTS OF THE INVENTION

It is the principal object of the present invention to provide an improved hand mounted aid which increases the gripping effect of the bowler's hand while holding a bowling ball in order to allow the bowler to generate the desired lift, turn, axis rotation, and axis tilt during and upon release.

Another object of the present invention is to provide an improved hand mounted aid which provides for a quicker thumb release while adding strength to the rest of the gripping hand, to allow a significantly longer time delay between the thumb exiting the gripping hole and the gripping fingers and index finger leaving contact with the bowling ball.

It is another object of the present invention to provide an improved bowling aid of the foregoing character which maximizes the surface area of the bowler's hand while delivering the bowling ball.

It is a further object of the present invention to provide a bowling aid that increases the control of the bowler's hand while holding a bowling ball during delivery.

It is yet a further object of the present invention to provide a bowling aid that increases the surface area of at least one of the bowler's fingers for contact with the bowling ball during delivery to enhance lift or turn.

SUMMARY OF THE INVENTION

In accordance with the foregoing objects, the present invention is embodied in a bowling aid adapted to be mounted on either the bowler's index or little finger. The aid is in the form of a sheath into which the bowler's finger is inserted. Appropriate padding is provided in the sheath for gripping and protecting the finger. On the outer end of the sheath there is provided a plate which extends outwardly from the sheath and is provided with a concave surface with a frictional coating thereon for assisting the bowler in maintaining contact with the bowling ball, the concave surface and friction coating extending along the length and width of the sheath. The bowler presses the plate and the length and width of the sheath against the surface of the ball during bowling to generate enhanced contact to the bowling ball. The enhanced contact which is thus achieved greatly assists the bowler in generating lift and turn, increasing ball revolutions and generating proper axis rotation and axis tilt during bowling.

In particular, a bowling aid is described for placement on a finger of a bowler's hand for enhancing a bowler's control of a bowling ball, the bowling ball having a spherical outer surface. The bowling aid includes a tubular sheath portion having opposite open ends defining a through bore sized to snugly receive a bowler's finger through either of the open ends. A first plate portion extends beyond one of the open ends having a spherical underside surface for contacting the spherical outer surface of the bowling ball, the plate portion having an upper surface for contacting at least a portion of a metacarpal joint of a bowlers finger when the bowler's finger extends into one of the open ends of the tubular portion.

Further, another embodiment of a bowling aid includes a first sheath having a length and defining a bore receiving a bowler's finger, the sheath defining a continuous gap along its length. A plate is attached to a free end of the sheath and extends outwardly from the sheath. The sheath and the plate have a lower surface shaped to engage an outer surface of a bowling ball when pressed against the ball by the bowler's finger. A fastener is attached to the sheath for clamping the sheath on the bowler's finger.

Further, a full finger insert for positioning in a bowling aid is disclosed, the insert includes a tubular main body having a length and defining a plurality of longitudinally oriented sections separated by serrations formed in said main body. The sections are separable for the main body by tearing along the serrations.

BRIEF DESCRIPTION OF THE DRAWINGS

FIG. 3 is an enlarged perspective view of a bowling aid embodying the present invention.

FIG. 4 is an enlarged top plan view of the bowling aid shown in FIG. 3.

FIG. 5 is a side elevation view of the bowling aid shown in FIG. 4.

FIG. 12 is a top plan view of the bowling aid shown in FIG. 9.

FIG. 13 is a top plan view of another alternative embodiment of a bowling aid embodying the present invention.

FIG. 14 is a section view substantially in the plane of line 14—14 on FIG. 12.

FIG. 15 is a top plan view of the bowling ball and hand, illustrating the use of an alternative embodiment of the present invention.

DETAILED DESCRIPTION

Figure 1:
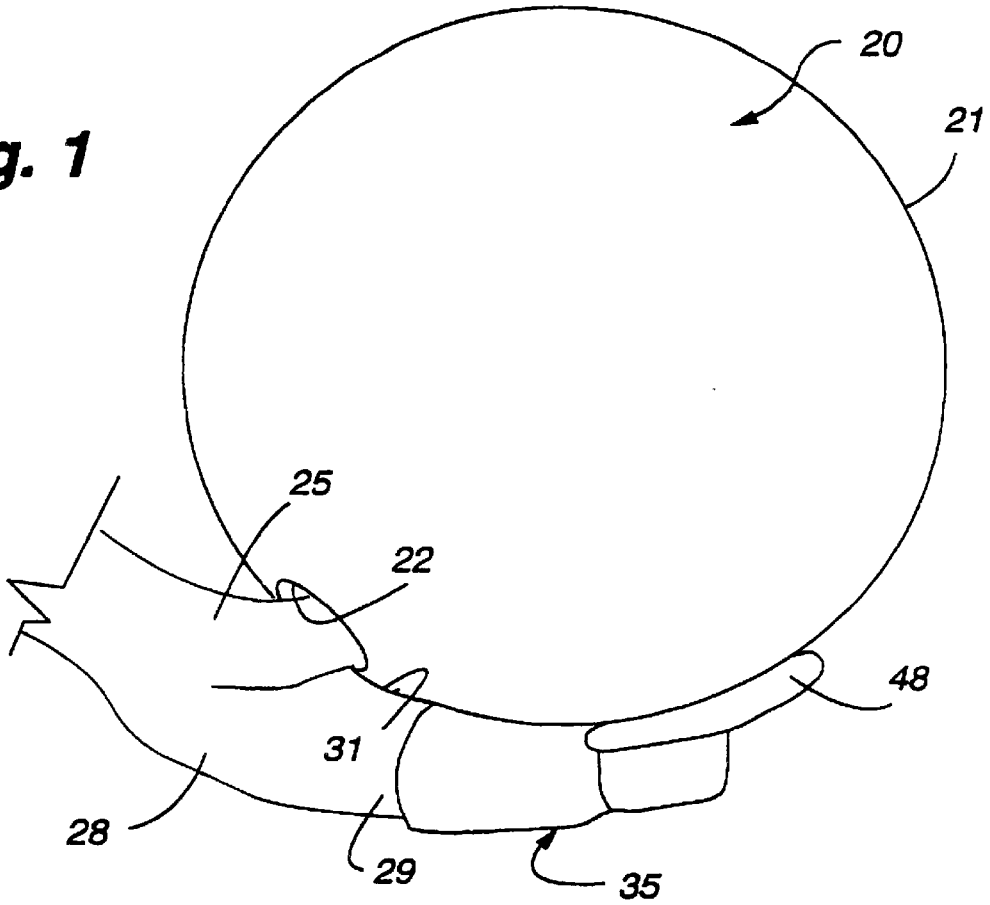
FIG. 1 is an elevation view of a bowling ball, held in a bowler's hand equipped with a bowling aid embodying the present invention.
Figure 2:
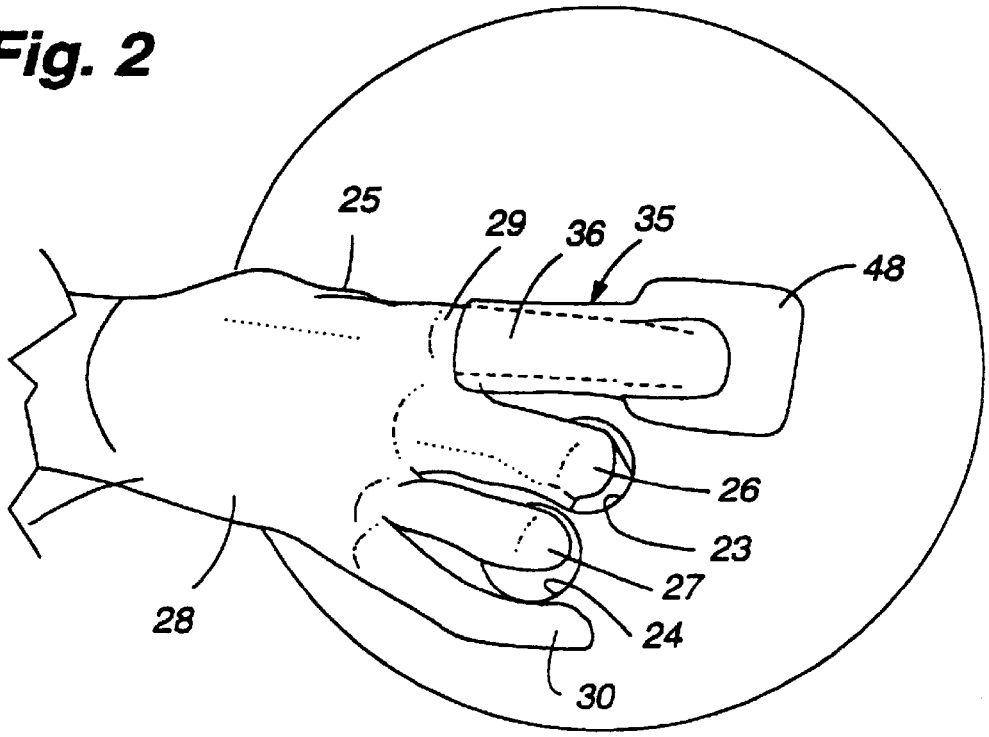
FIG. 2 is a top plan view of the bowling ball and hand shown in FIG. 1.

As shown in the drawings, a bowling ball 20, conventionally made of a hard material, defines a spherical outer surface 21. A plurality of apertures 22, 23, 24 are conventionally drilled in the bowling ball 20 for receiving respectively the thumb 25 and two middle fingers 26, 27 of the bowler's hand 28. The index finger 29, little finger 30, and the bowler's palm 31 normally rest on and contacts the outer surface 21 of the bowling ball 20 when the bowling ball is held by the bowler.

The preferred embodiment of a bowling aid 35 embodying the present invention, as shown in FIGS. 1–8, is a rigid sheath for application to the index finger 29 of the bowler's hand 28 and is formed as a tubular main body 36 defining a bore 38 extending continuously therethrough from a first end finger receiving opening 39 to a second end opening 40. The tip of the index finger of the bowler is inserted through the first opening 39 into the bore 38, and is snugly held therein by a resilient insert sleeve 41. A resilient cushion 42 is provided in the tubular sheath 36 for padding the upper portion of the bowler's finger to provide a snug fit and prevent injury thereto.

The insert 41 may be removable from the bowling aid. To this end, the insert 41 fits in a cavity 44 defined within the outer shell 36, and dimensioned to receive the insert 41. The insert 41 is held in the recess by an inwardly extending flange 45 spaced from the opening formed at the second end of the main body, and an internal shoulder 46 adjacent the outer end of the shell 36. The insert 41 is positioned within the recess by compressing and inserting the insert through the aperture 40 formed in the end of the main body, and releasing the insert so that it expands to its normal dimensions and is securely held within the recess 44. The insert can likewise be removed in the same manner.

Figure 6:
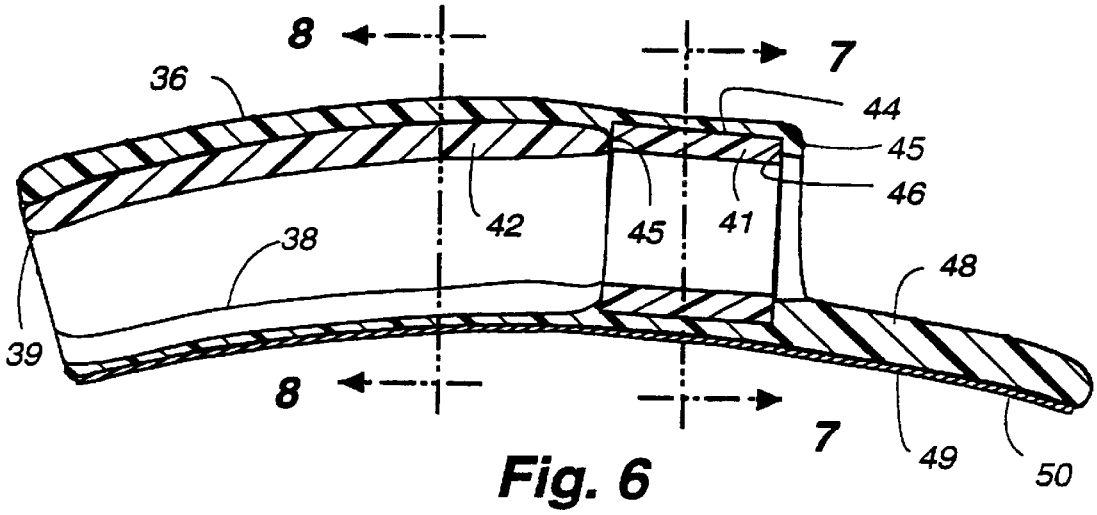
FIG. 6 is a section view taken substantially in the plane of line 6—6 of FIG. 4.
Figure 6A:
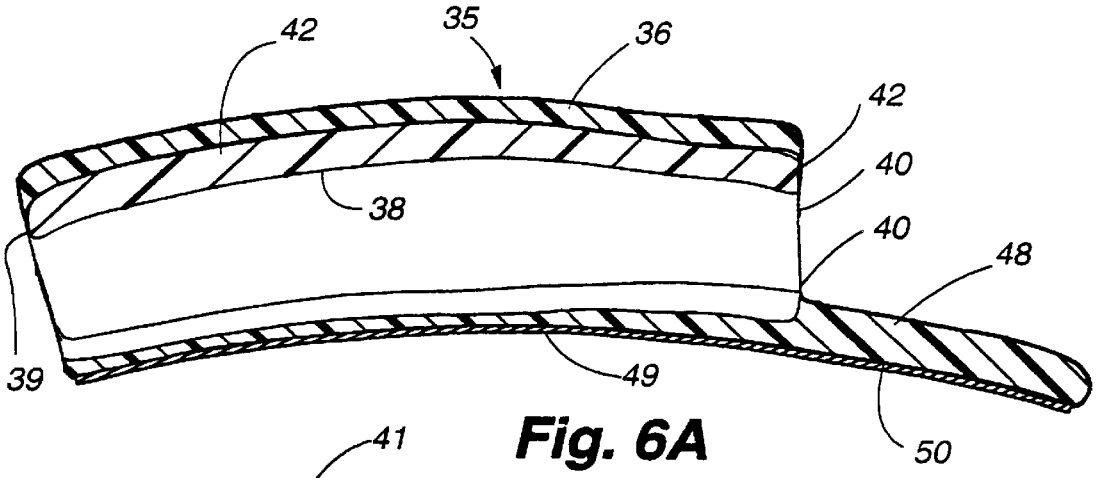
FIG. 6A is a representational section view of an alternative embodiment of the present invention.
Figure 7:
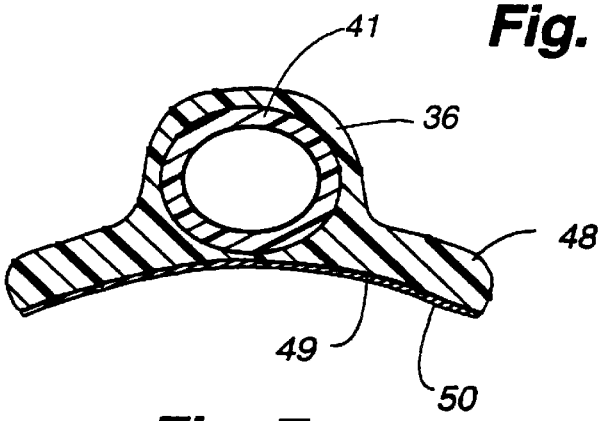
FIG. 7 is a section view taken substantially in the plane of line 7—7 on FIG. 6.
Figure 8:
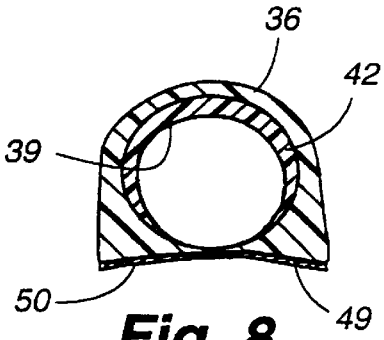
FIG. 8 is a section view taken substantially in the plane of line 8—8 on FIG. 6.
Figure 9:
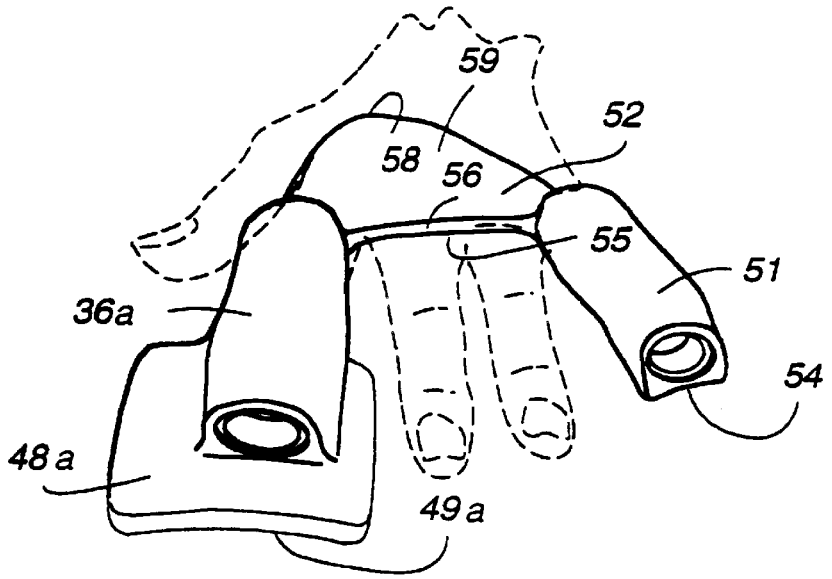
FIG. 9 is a front perspective view of a bowler's hand with an alternative embodiment of the bowling aid embodying the present invention.
Figure 10:
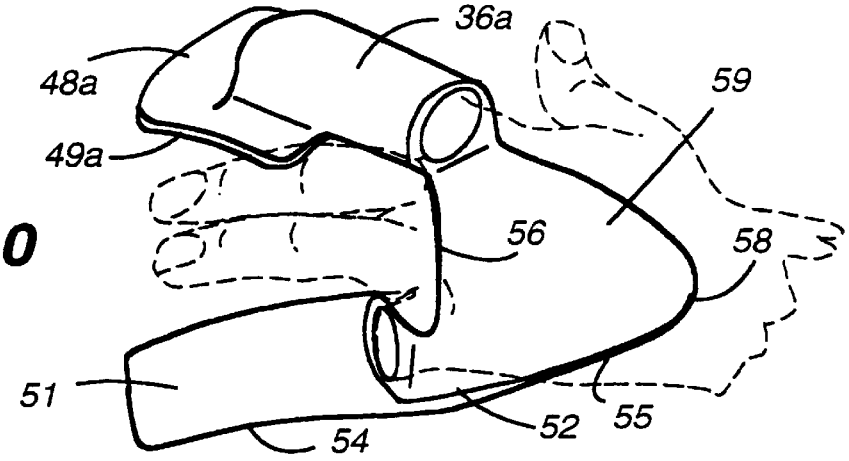
FIG. 10 is a rear perspective view of the hand and bowling aid shown in FIG. 9.

Alternatively, the entire length of the sheath 36 can have resilient cushion 42 extending inside the sheath 36 from the first end finger receiving opening 39 to the second end opening 40, as shown in FIG. 6A. The tip of the index finger of the bowler is inserted through the first opening 39 into the bore 38, and is snugly held therein along its length by the resilient foam 42, without the insert 41 being necessary. The resilient cushion 42 is provided in the tubular sheath 36 for padding the upper portion of the bowler's finger along its entire length, and to provide a snug fit and prevent injury thereto.

A bottom surface 49 of the sheath body 36 engages the surface 21 of the bowling ball 20. In addition, an enlarged plate or paddle 48 can be integrally formed on the sheath body 36 to extend laterally outwardly from the sides and longitudinally outwardly the forward end of the sheath 36. The plate or paddle 48 is formed with a bottom surface integral with bottom surface 49 of the sheath body 36 having a concave spherical curvature identical to the curvature of the outer surface 21 of the bowling ball 20. The bottom surface 49 is preferably covered with a gripping material 50, such as an elastomer or latex layer, to provide a frictional gripping engagement with the surface 21 of the ball 20.

The paddle 48 is integrally formed with and extends outwardly from the main body sheath 36 as an extension thereof. Like the main body sheath 36, the paddle is relatively rigid. The paddle preferably extends past the forward end of the sheath body 36 to an extent up to about 50% of the length of the sheath body, and is generally square in shape. The shape of the paddle can be modified as desired by the bowler.

A modified embodiment of the bowling aid of the present invention is shown in FIGS. 9–14. In describing this embodiment, like elements to those described above will be indicated by similar reference numerals with the distinguishing suffix "a."

The alternative embodiment of the bowling aid (FIGS. 9–14) includes a main rigid sheath body 36*a* for receiving the bowler's index finger 29 and a second sheath 51 for receiving the little finger 30. The two main sheaths 36*a*, 51 are attached together by a rigid bridge 52 extending between the index finger main body 36*a* and the little finger main body 51 adjacent the first ends thereof. The main body 36*a* for the index finger is made identically to the main body as described above, and includes a plate or paddle 48*a* and ball contact surface 49*a*. The main body 51 for receiving the little finger is constructed identically to the main body 36*a* for receiving the index finger, with necessary modifications made in light of the differences in size of the two fingers. The main body sheath 51 for receiving the little finger may or may not include a paddle, but does define a spherical concave ball contact surface 54 along its length and width.

Figure 11:
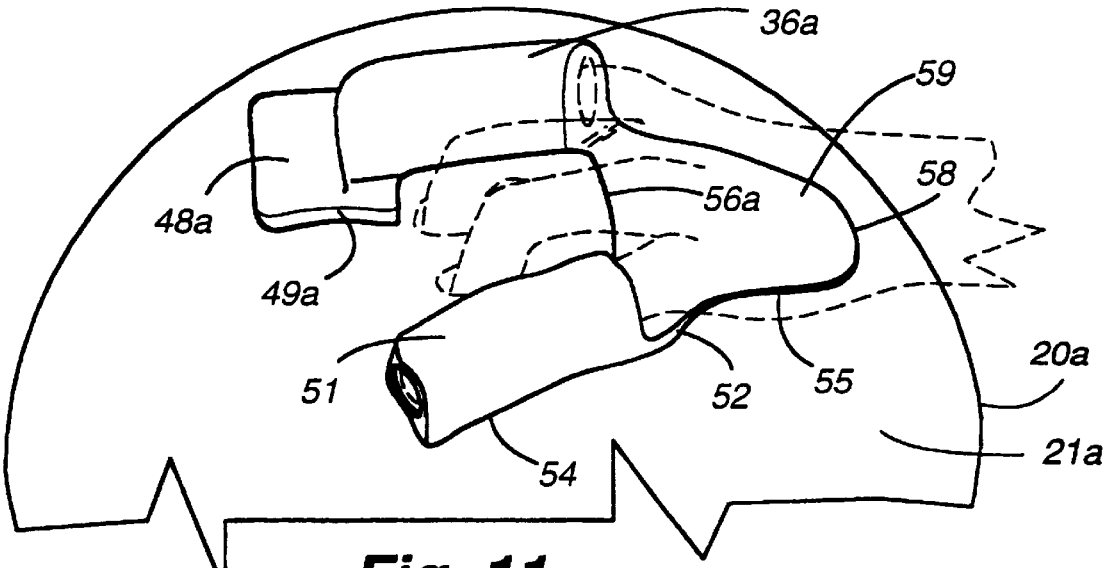
FIG. 11 is a side perspective view of the bowling aid shown in FIG. 9 as positioned on a bowling ball.

The bridge 52 connecting the index finger main body 36*a* and the little finger main body 51 is integrally formed with each of the main body sheaths, and defines a spherical contact surface ball 55 coextensive with the contact surfaces of the two main bodies, as shown in FIG. 14. The bridge 52 is formed by a thin, rigid plate defining a front edge 56 and a rear edge 58. The front edge 56 lies between the finger sheaths 36*a*, 51 and forwardly of the finger receiving ends thereof. The rear edge 58 of the bridge 52 extends rearwardly from the sheaths to be under the palm 31 of the bowler's hand. The ball contact surfaces 49*a*, 54 of the sheaths and bridge surface 55 coextensively engage the outer surface 21*a* of a bowling ball 20*a* when in use, as shown in FIG. 11.

The bridge 52 also defines an upper surface 59 on which a thin cushion material 60 (FIG. 14) may be affixed to help ensure contact with the bowler's hand during use. The cushion layer 60 can be made of a closed-cell foam which adapts to the individual shape of the bowler's hand, yet has adequate firmness to maximize the bowler's feel and control of the bowling ball.

A further modified embodiment of the bridge is shown in FIG. 13. In describing this modification, reference characters similar to those used above will be employed with the distinguishing suffix "b." In this modification, the bridge 52*b* is narrow and extends between the first ends of the index finger sheath 36*b* and the little finger sheath 51*b*. The palm of the bowler thus does not cover the bridge 52*b*. The bridge 52*b* essentially underlies the base of the knuckles of the bowler. This smaller bridge 52*b* also has a contact surface (not shown) having the same spherical curvature as the larger bridge member to ensure complete contact with the bowling ball during use. The contact surface of the bridge member as well as the index finger sheath 36*b*, paddle 48*b*, and little finger sheath 51*b* all have a gripping or frictional material applied thereto (not shown), to provide enhanced gripping characteristics.

Another modified embodiment of the bowling aid of the present invention is shown in FIG. 15. In describing this embodiment, like elements to those described above will be indicated by similar reference numerals with the distinguishing suffix "c."

This alternative embodiment of a bowling aid 35*c* embodying the present invention, as shown in FIG. 15, includes a sheath 36*c* which is identical to the sheath 36 described above, except that the sheath is sized and dimensioned to be worn on a bowler's little finger. This version of the a rigid sheath 36*c* for application to the little finger can have a paddle 48*c* as desired.

In use, the bowling aid of the present invention increases the ball contact surface area of the bowler's finger, which in turn enhances the bowler's ability to generate the lift, turn, axis rotation and axis tilt upon release of the bowling ball.

The bowling aid, when used, allows the fingers of the bowler to stay on the ball longer, but creates earlier thumb exit, and in combination with the increased surface area and frictional contact between the bowling aid and the bowling ball, assists the bowler in generating lift and turn with natural wrist action through the release, and thus increasing ball revolutions and helping to obtain proper axis rotation and axis tilt, thereby helping to improve the bowler's score.

Given the fact that the middle finger substantially controls the turn performance, and the ring finger substantially controls the lift performance, the bowling aid can be worn only on the index finger to improve a bowler's turn performance, and can be worn only on the little finger to improve the bowler's lift (revolution) performance. The combination index and little finger bowling aids 35, with the rigid bridge connecting the two, as described above, can be used to improve both lift and turn performance simultaneously. Generally, the bowling aid of the present invention works in a number of ways to strengthen any of a variety of weaknesses from which a bowler may suffer. The bowling aid can stabilize the bowling ball in the user's hand, provide a feel for a better overall swing, and assist in proper release for improved lift, turn, axis rotation and axis tilt.

Figure 16:
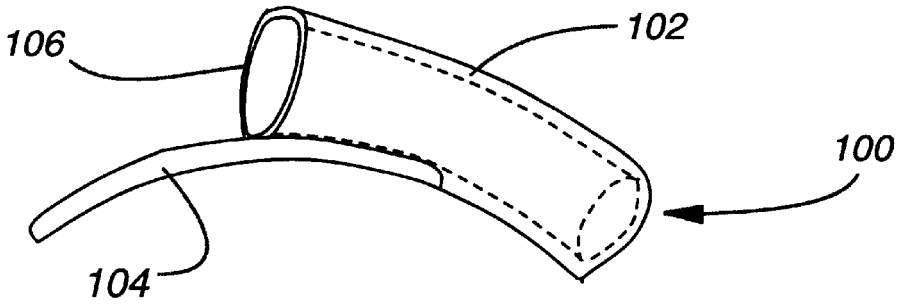
FIG. 16 is a side view of a reversible alternative embodiment of the bowling aid in accordance with the present invention.
Figure 17:
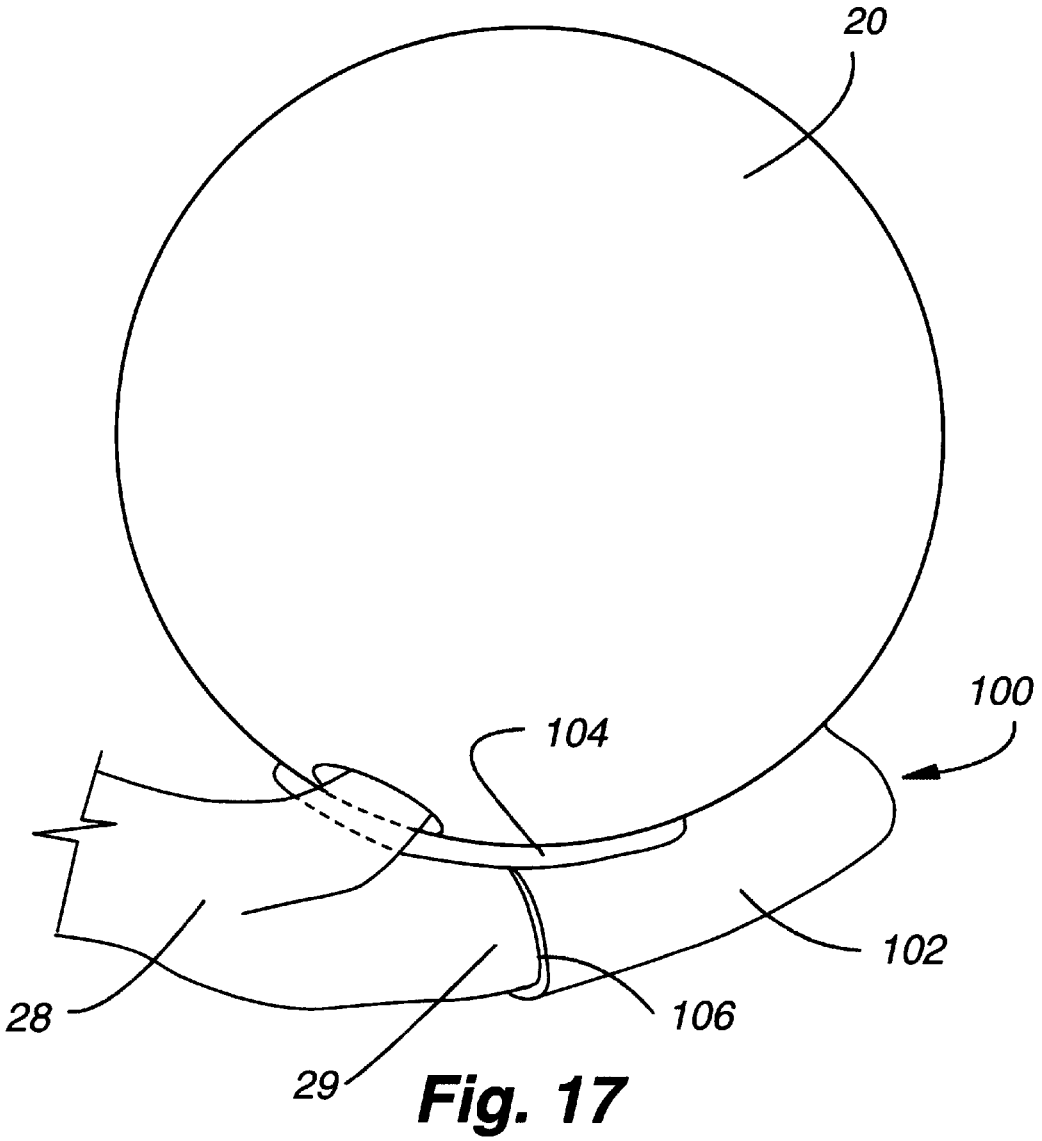
FIG. 17 is a side perspective view of a bowling ball and bowlers' hand using the alternative embodiment of the bowling aid shown in FIG. 16.
Figure 18:
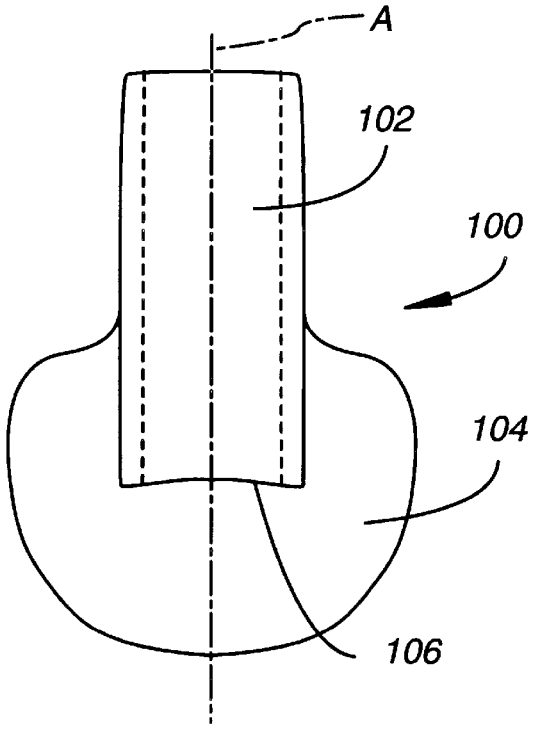
FIG. 18 is a plan view of the reversible alternative embodiment of the bowling aid shown in FIG. 16.

To this end, further embodiments of the invention are shown in FIGS. 16 through 22. Each of these embodiments includes the friction coating on the underside surface contacting the bowling ball 20 to improve the bowler's control as above described. Referring specifically to FIGS. 16 to 18, an alternative bowling aid 100 is shown in a side view and a plan view in FIGS. 16 and 18, respectively. A perspective view of the bowling aid 100 is shown on the index finger 29 of a bowlers' hand 28 holding a bowling ball 20 upright in preparation for release. The bowling aid 100 comprises an open tubular sheath portion 102 and a plate portion 104 integral with and extending outward from beneath the proximal end 106 of the tubular portion 102. The plate portion 104 is generally symmetrical laterally with respect to the central axis A of the tubular portion 102. In this embodiment, a bowler places his or her index finger fully into the tubular portion 102 from the proximal end 106 so that the plate portion 104 underlies the palm of the bowler's hand 28, specifically at least the second metacarpal joint. The plate portion 104 preferably has a shallow, generally spoon shape complementary to the spherical surface of the bowling ball 20 on its under surface and a slightly convex upper surface to accommodate part of the palm of the bowlers hand. In addition, the tubular portion 102 is open at both ends to permit a bowler to reverse the aid 100 from that shown in FIG. 17 to that shown in FIG. 2 if desired.

The placement of the plate portion 104 under the second metacarpal joint permits the bowling aid 100 to correct the orientation of the ball to the bowler's hand. The thickness of the plate portion 104 may be varied or the surface sculpted for use as an orthopedic aid to cushion the metacarpal joint as well as compensate for subtle abnormalities in joint alignment which can improve the capability of the bowler to consistently achieve proper release of the ball.

Figure 19:
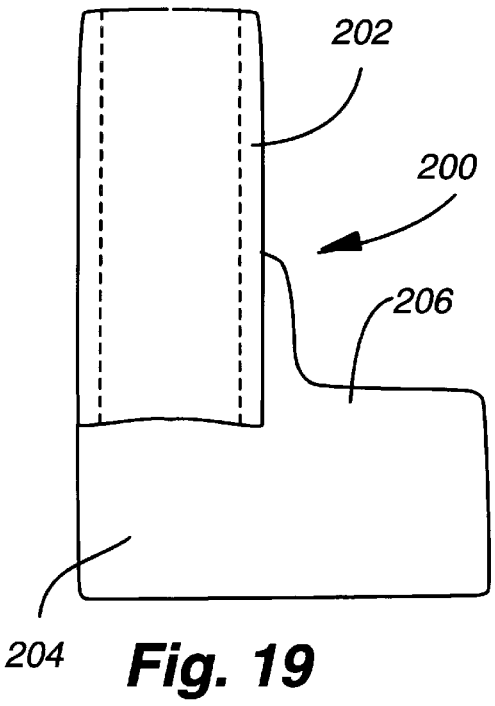
FIG. 19 is a plan view of an asymmetric right hand bowling aid in accordance with a still further embodiment of the invention.
Figure 20:
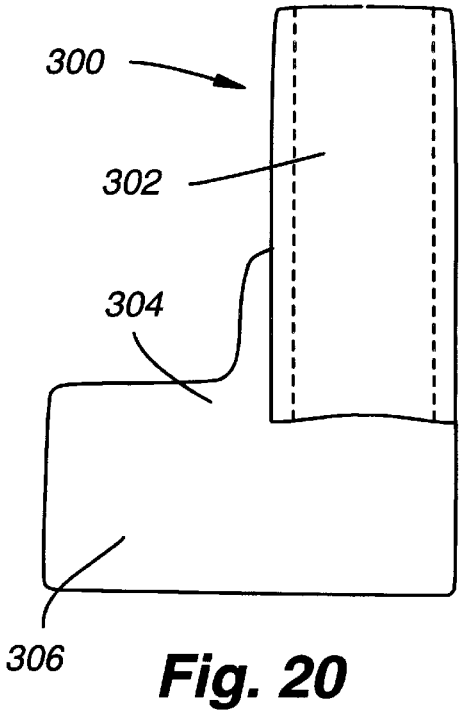
FIG. 20 is a plan view of an asymmetric left hand bowling aid in accordance with the invention.

Another alternative embodiment of the present invention is shown in FIGS. 19 and 20. The bowler's aid 200 in FIG. 19 is similar to the embodiment 100 just described with a tubular portion 202 and a plate portion 204 except that the plate portion 204 is asymmetrically shaped specifically for a right handed bowler. Thus in the plan view of FIG. 19, the aid 200 has an L shape with an elongated extension 206 of the plate portion 204 forming the short leg of the L. This extension 206 is designed to fit beneath the second metacarpal joint and may extend beneath the third or fourth metacarpal joints as well. The upper surface of the plate portion 204 may be dished to receive or mate with the rounded surfaces of the head metacarpal joint tubercle and may also be varied in thickness to compensate for specific hand shapes in order to orthopedically correct the hand position of the bowler.

The alternative embodiment 300 shown in FIG. 20 is the same as that shown in FIG. 19 except that the aid 300 is designed for a left handed bowler. The aid 300 comprises an elongated tubular sheath portion 302 sized to snugly receive the bowler's index finger and a plate portion 304 having an elongated extension 306 extending generally laterally, at a right angle, to the tubular portion 302. The plate portion 304 has a smooth curved underside shaped complementarily to the spherical surface of the bowling ball and an upper surface shaped to receive the head metacarpal joint of at least the index finger of the bowler's hand. The upper surface of the extension 306 cushions the metacarpal joint of the third or middle finger of the bowler's left hand.

The bowler's aid 200 and 300 may alternatively be worn on the little fingers of the bowler's left and right hands, respectively. In this case, of course, the tubular portions 202 and 302 would have to be smaller in internal diameter to snugly fit the smaller little finger. In this alternative application, the extension 206 or 306 would underlie at least the bowler's fourth metacarpal joint of his/her ring finger.

Figure 21:
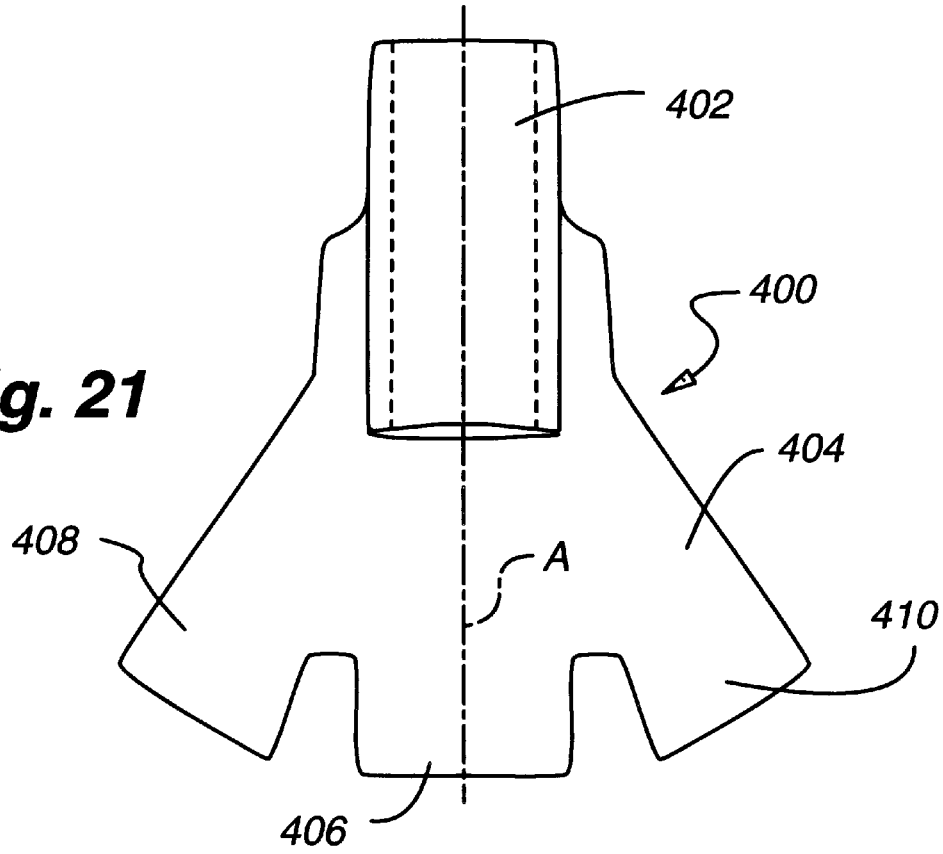
FIG. 21 is a plan view of a symmetrical bowling aid in accordance with the further embodiment of the invention.

A symmetrical bowler's aid 400, shown in FIG. 21, may be used by a right or left handed bowler, and on either the index or little finger. The bowler's aid 400 has a tubular portion 402 and a plate portion 404 which comprises a central extension 406, a left extension 408, and a right extension 410. The left and right extensions 408 and 410 are designed and shaped to fit beneath the head metacarpal joints of the index and middle fingers of either the right or left handed bowler. The central extension 406 fits beneath the palm of the bowler's hand. Again, the thicknesses and contours of the upper surfaces of the plate portion 404 may be tailored specifically to the bowler's hand to compensate for individual hand structure variations and to assist in ensuring a consistent ball release and thereby improve the bowler's performance.

Again, in the embodiments 200, 300, and 400, the tubular portions 202, 303, and 404 are open ended so that the aid may be reversed to position the plate portion under the tip of the index finger for improved control of ball release as in the first embodiment described above with reference to FIGS. 1–8.

Figure 22:
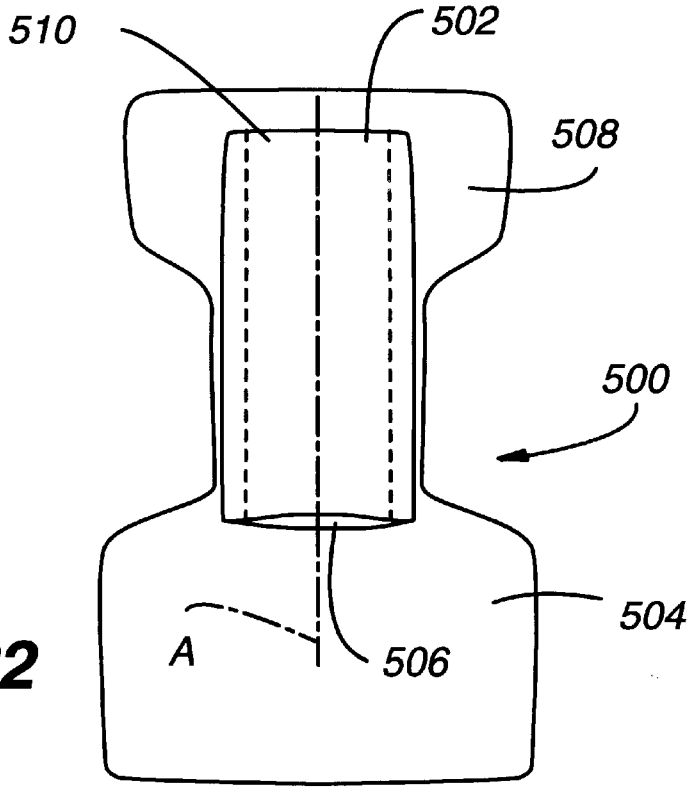
FIG. 22 is a plan view of a still further reversible alternative embodiment of the invention.

Referring now to FIG. 22, a still further embodiment of the bowling aid is shown. The "dog bone" shaped aid 500 comprises an open tubular sheath portion 502 and a plate portion 504 integral with and beneath the proximal end 506 of the tubular portion 502. A second plate portion 508 is integral with and partially beneath the distal end 510 of the tubular portion 502. In this embodiment of the bowler's aid 500, a bowler places his or her index finger fully into the tubular portion 502 from the proximal end 506 so that the plate portion 504 underlies the palm of the bowler's hand, specifically at least the second metacarpal joint if the aid is used on the index finger. The plate portion 504 would lie under the fifth metacarpal joint if the bowler places the aid on his/her little finger. The plate portion 504 preferably has a shallow, generally spoon shape complementary to the spherical surface of the bowling ball 20 on its under surface and a slightly convex upper surface to accommodate part of the palm of the bowlers hand. In addition, the tubular portion 502 is open at both ends to permit a bowler to reverse the aid 500 if desired.

The placement of the plate portion 504 (or 508) under the second metacarpal joint permits the bowler aid 500 to correct the orientation of the ball to the bowler's hand. The thickness of the plate portions 504 and 508 may be different and/or the surface of these portions may be sculpted for use as an orthopedic aid to cushion the metacarpal joint as well as compensate for subtle abnormalities in joint alignment which can improve the capability of the bowler to consistently achieve proper release of the ball.

For example, the plate portion 504 may be wider than the plate portion 508 and the thickness of plate portion 504 may be greater than the thickness of portion 508 so that the bowler can vary the release orientation of the ball 20 in his/her hand by merely reversing the aid 500 on her finger. In addition, the "dog bone" shape retains the control advantage attributable to the first embodiment described above while at the same time providing a correction or cushion for the metacarpal joint of the index finger. The dog bone shape also increases the contact area of the aid with the ball surface beyond that attainable with the first embodiment shown in FIGS. 1–8. This embodiment shown in FIG. 22 may also be modified to extend the plate portion 504 laterally so that it extends under the third metacarpal joint as in the embodiments 200 and 300 shown in FIGS. 19 and 20 when the aid 500 is worn on the index finger and under the fourth metacarpal joint if the aid 500 is worn on the little finger. However, in this case, the reversibility just mentioned could be compromised.

In all embodiments described above, the bowler benefits from improved control of the bowling ball during the release of the bowling ball.

Another embodiment of the present invention, as shown in FIGS. 23 through 28, includes a sheath 600, as generally described above, having an upper portion 602 separate from a lower portion 604 and an attachment mechanism 606. This structure provides the user with a custom fit when the sheath is positioned on the user's finger.

Figure 23:
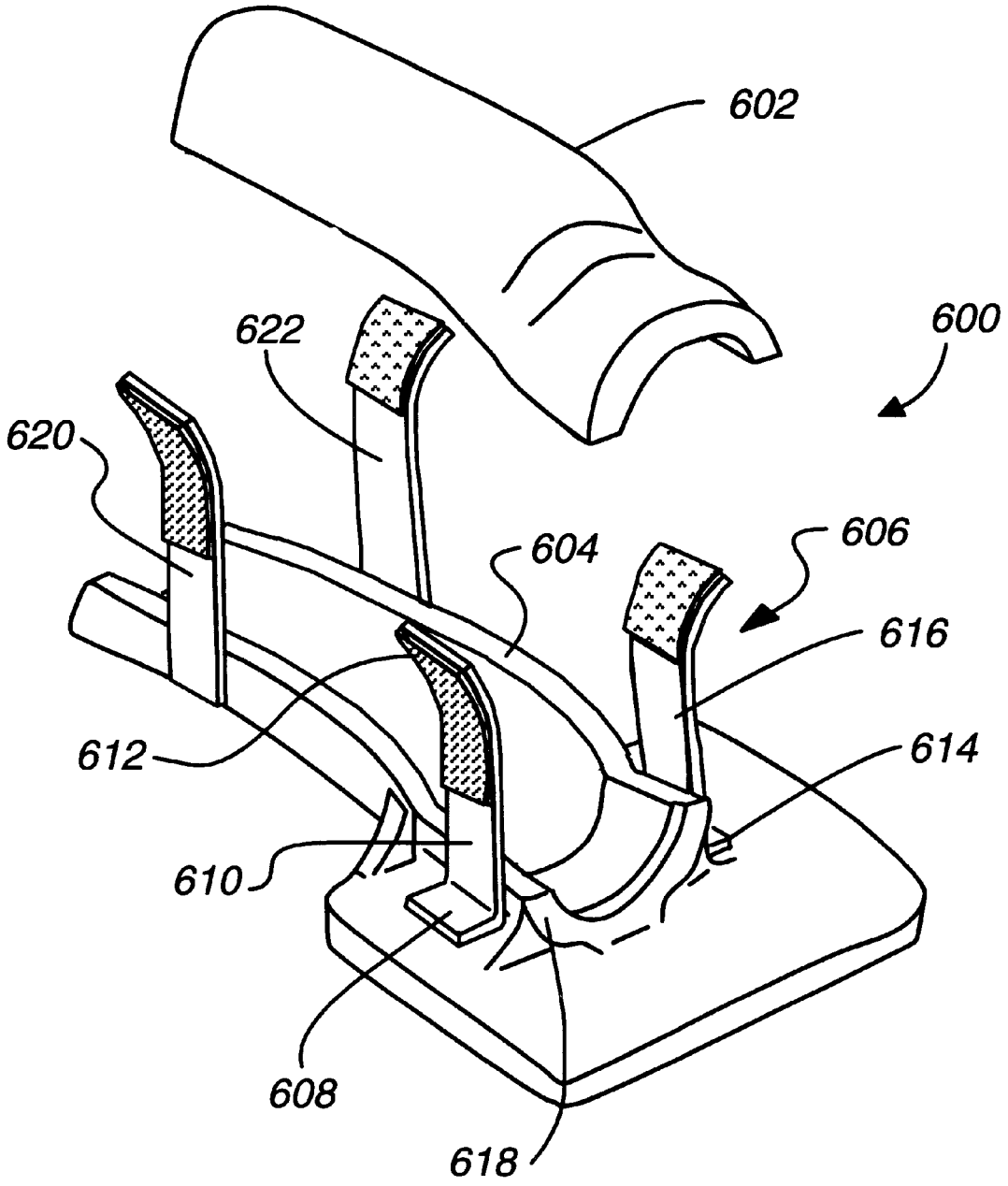
FIG. 23 is an exploded view of the embodiment of the sheath having a split housing.
Figure 24:
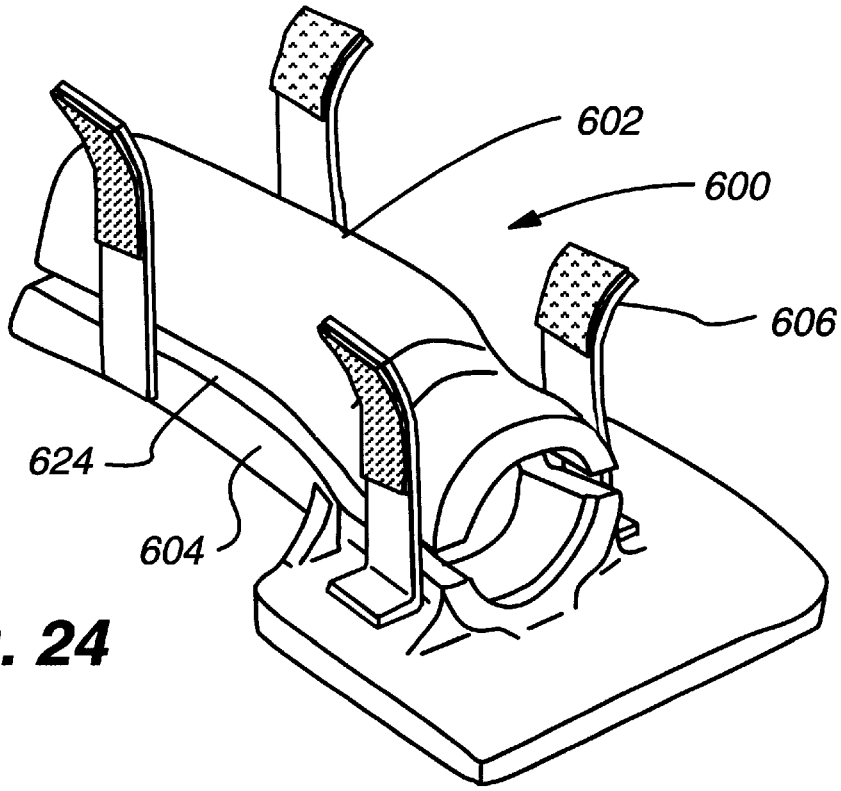
FIG. 24 is a front perspective view of the sheath embodiment having a split housing with the upper portion positioned near the lower portion.
Figure 25:
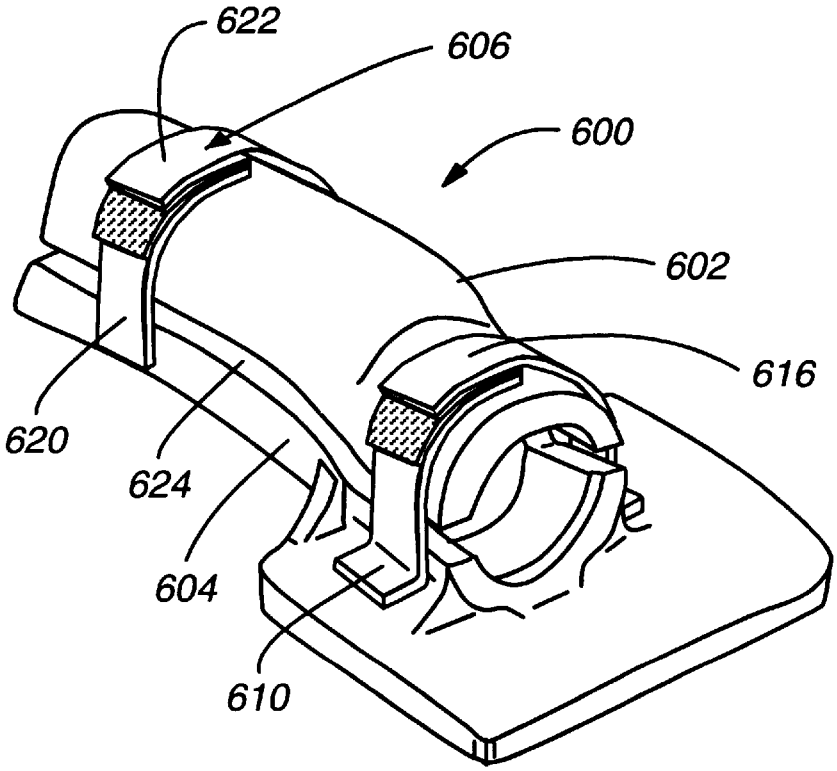
FIG. 25 is a perspective view of the embodiment of the sheath having a split housing with the releasably fasteners attaching the upper portion of the housing to the lower portion of the housing.

One version of this embodiment is shown in FIGS. 23 through 25. The upper portion 602 is releasably held to the lower portion 604 by hook and loop fasteners 606, or the like. The bottom end 608 of a first elongated strap section 610 of the hook and loop fastener is attached to the lower portion 604, with the other end 612 extending freely away therefrom. The bottom end of the corresponding second elongated strap section 616 of the hook and loop fastener is attached to the lower portion 604 directly opposite the first section. The first 610 and second sections 616 are fixedly attached to the bottom portion 604 by any known means, and are adjacent one end 618 of the sheath 600. A similar third 620 and fourth 622 sections of the hook and loop fastener 606 are similarly attached to the bottom portion adjacent the opposite end of the sheath 600.

The user's finger is first positioned in the bottom portion 604 of the sheath, with the top portion 602 then placed over the bottom portion 604. A gap or slot 624 is formed along either elongated edge of the sheath 600 to allow vertical adjustment of the top portion 602 with respect to the bottom portion 604, to fit differently-sized fingers (FIG. 25). The top 602 and bottom 604 portions of the sheath 600 are sized such that there is preferably a gap 624 along at least one longitudinal edge, such that when the fasteners 606 are used, they apply a clamping or compressive force on the finger to secure the sheath 600 to the finger, as is described below.

With the top 602 and bottom 604 portions of the sheath 600 so positioned, the first section 610 of the fastener 606 is engaged with the second section 616 of the fastener, as shown in FIG. 25. The third section 620 of the fastener is engaged with the fourth section 622 of the fastener, as also shown in FIG. 25. This acts to clamp the finger between the top portion 602 and the bottom portion 604 and securely hold it therein. The amount of clamping force can be adjusted for a given finger size by re-adjusting the engagement of the fasteners. The fasteners are used to allow a larger or smaller finger to be adequately clamped between the top 602 and bottom 604 portions.

Once positioned on the finger, the sheath 600 operates to improve the bowler's control of the bowling ball upon release, as described above.

Figure 26:
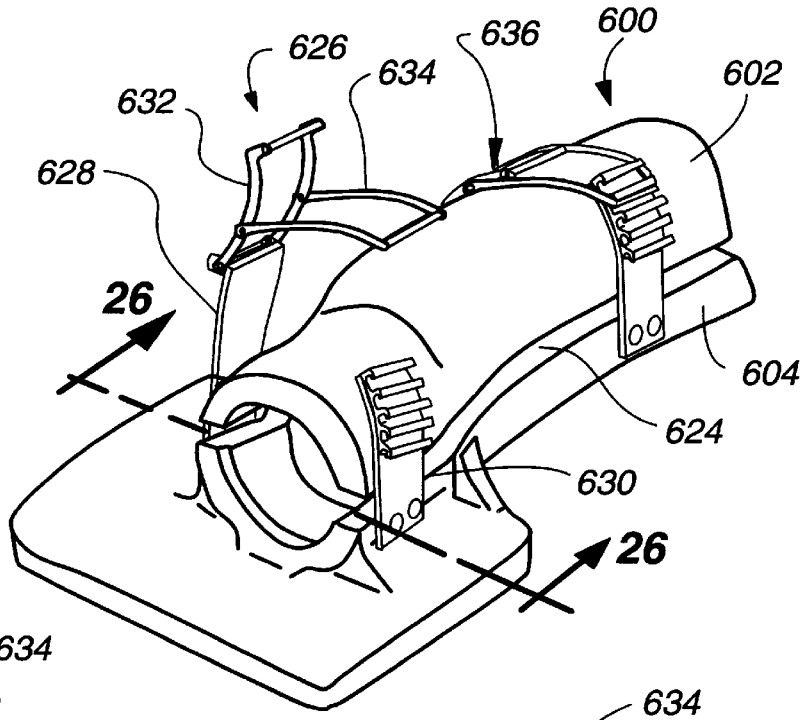
FIG. 26 is a perspective view of an embodiment of the sheath having a split housing, utilizing over-center buckles for securing the top portion of the housing to the bottom portion of the housing.
Figure 27:
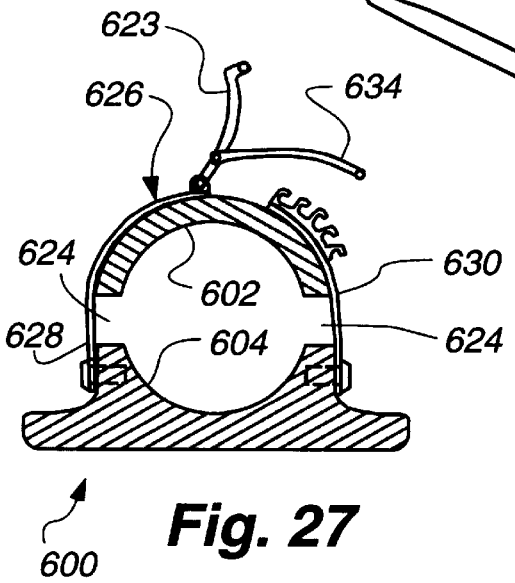
FIG. 27 is a section taken along lines 27—27 of FIG. 26.
Figure 28:
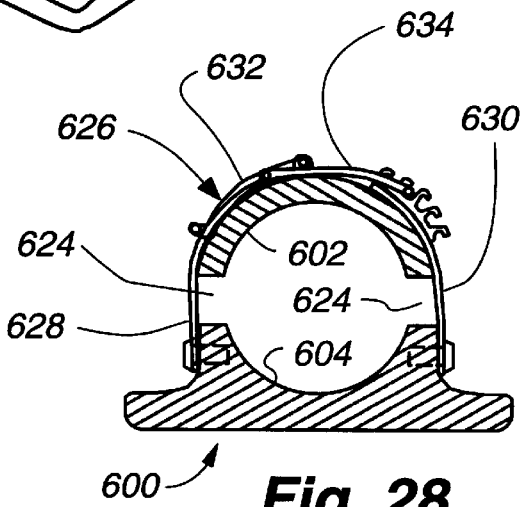
FIG. 28 is a representational section similar to FIG. 27 showing the over-center latch in the engaged condition.

A second embodiment of the split sheath is shown in FIGS. 26–28. In this embodiment, an adjustable over-center buckle mechanism 626 is used to secure the top portion 602 to the bottom portion 604. The base portion 628 of the front buckle is mounted to the lower portion 604, with the toothed-end 630 of the front buckle being mounted to the lower portion 604 laterally opposite the base portion 628. The latch 632 is attached to the base portion 628, and the bale 634 is attached to the latch 632, as in conventional over-center buckles. To clamp the top portion 602 and bottom portion 604 to a finger, the bale 634 is engaged with the toothed-end 630 (see FIG. 28), and the latch 632 is folded to be positioned over the base end 628. A similar over-center buckle 636 is attached adjacent the opposite end of the sheath.

In the clamped position, a gap 624 exists preferably along the opposing longitudinal edges of the sheath between the top portion and the bottom portion. The relative position of the top portion 602 with respect to the bottom portion 604 can be changed by adjusting the position of the bale 634 in the toothed-end 630 of the buckle 626. In this way, fingers of differing sizes can be sufficiently secured in the single sheath.

Figure 29:
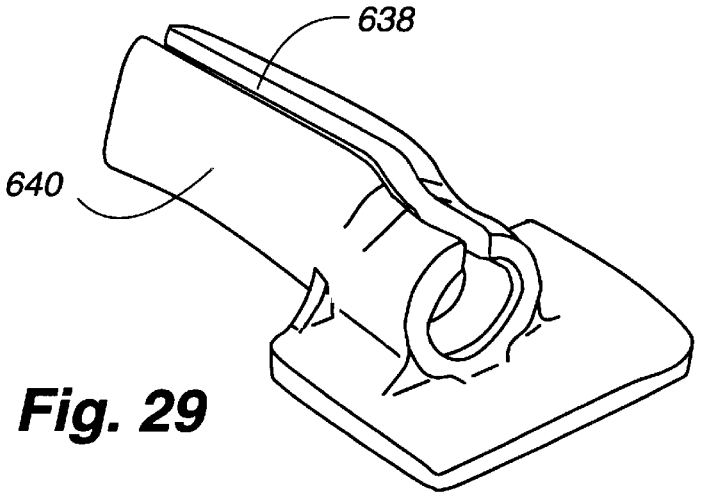
FIG. 29 is a front perspective view of an embodiment of the sheath defining a single gap.

As shown in FIG. 29, a single gap 638 can be formed anywhere on the top surface of the sheath 640, eliminating the top and bottom portions as described above. The gap 638 is sized to not close when used with any normally sized finger in order to allow adjustment for use on a small finger up to a large finger. The sheath material is able to flex under the force of the fastener system to allow adjustment for relatively small to relatively large fingers. The hook and loop fastener 606 or the buckle fastener 626, described above, would be suitable on this version to clamp a user's finger in the single-gap sheath 640, and be adjustable to accommodate various finger sizes.

Other types of fasteners and fastener techniques are contemplated for use on the sheaths having one or two gaps, such as criss-cross fasteners for improved stability, wider fasteners, and possibly more fasteners for enhanced fit along the length of the finger.

Figure 30:
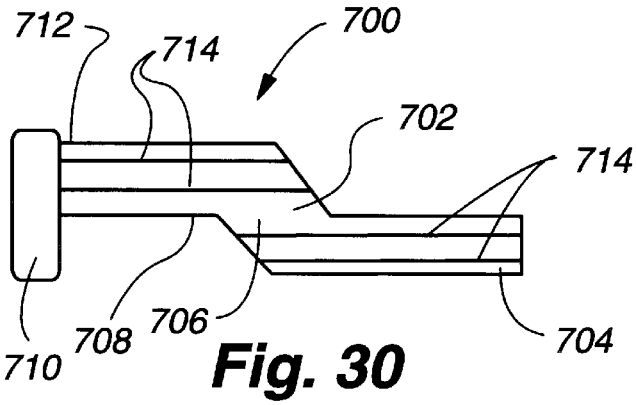
FIG. 30 is an elevation view of a full finger insert.
Figure 33:
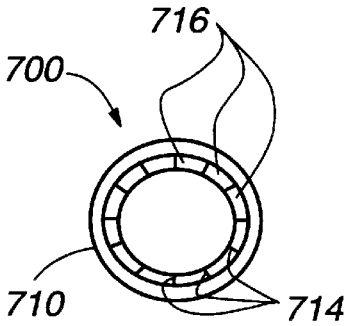
FIG. 33 is an end view of the full finger insert.
Figure 31:
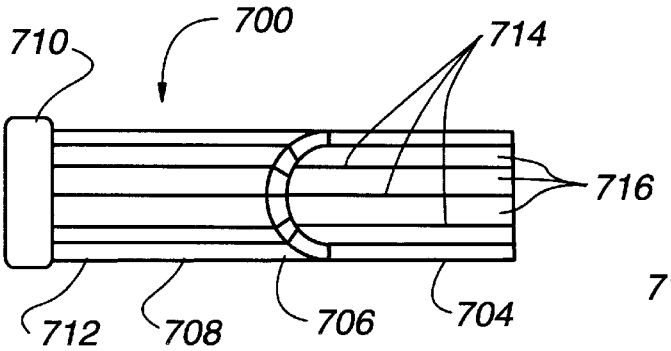
FIG. 31 is a plan view of the full finger insert as shown in FIG. 30.
Figure 32:
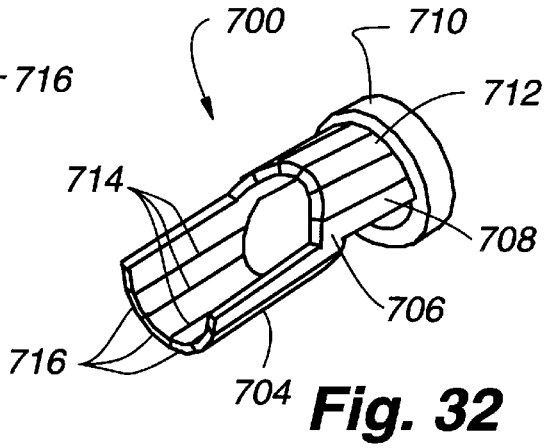
FIG. 32 is a perspective view of the full finger insert.

A universally-adjustable full-length insert 700 is shown in FIGS. 30–34. The full-length insert 700 is preferably for use in the sheath embodiments not having adjustable sizing. The full-length insert 700 has generally cylindrical main body 702 defining a front portion 704, a middle portion 706, a rear portion 708, and a collar 710 formed circumferentially around the end 712 of the rear portion 708. The main body is formed of a open-celled or closed-cell foam, or the like. Continuous serrations 714 run longitudinally along the length of the main body 702, except through the collar 710, to form removable sections 716. As can be seen in FIG. 33, the sections 716 are formed radially in the insert, and run continuously along its length (FIG. 30). As shown in FIGS. 30, 31 and 32, the front portion 704 has only a bottom half of the cylinder, the rear portion 708 has only the top half of the cylinder, and the middle portion 706 forms a slanted ring to extend from the front 704 to the rear portion 708.

Figure 34:
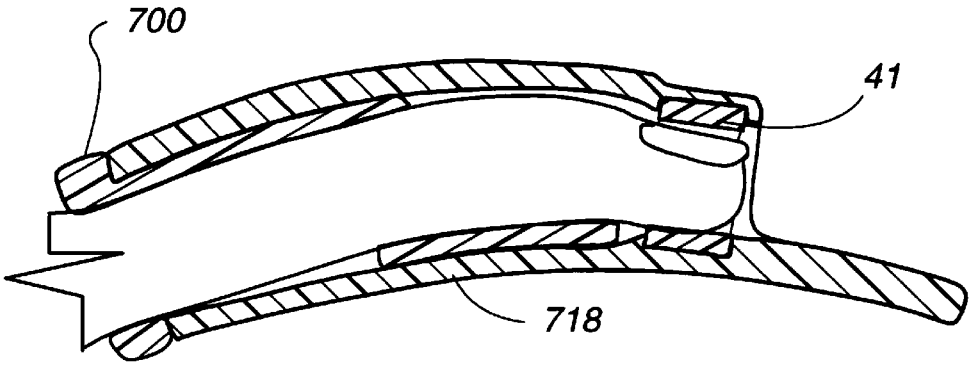
FIG. 34 is a representational section of the full finger insert positioned in a sheath, and receiving a bowler's finger.

The insert 700 is positioned in a shell of a sheath 718, as shown in FIG. 34. The sheath has the same external structure as described above in the first embodiments. The insert 700 butts up against the finger tip sleeve 41 (See FIG. 6 also), as described earlier. When inserted, the collar 710 covers the end 712 of the sheath which engages the hand of the user to act as a pad. The user can remove select sections 716 defined by the serrations 714 to decrease the size of the insert 700, to allow for a larger finger to be positioned in the sheath 718. A relatively small finger, such as a little finger, can be placed securely in the sheath 718 without removing any of the sections 716, while a relatively large finger, such as an index finger, can be securely positioned in the sheath 718 when some of the sections 716 are removed. To remove a section 716, the user simply tears the section along the serration lines 714 along either side of the section 716. Removing a section 716 allows a relatively larger finger to fit into a fixed-size sheath 718, and thus eliminates the need for manufacturing sheaths for different finger sizes.

The configuration of the insert 700 helps keep the bowler's finger properly positioned in the sheath 718 to maximize the contact of the sheath 718 with the bowling ball. The base of the finger in the rear portion 708 of the insert 700 is pushed lower in the sheath 700 and closer to the bowling ball by the rear portion 708 of the insert 700. The front portion 704 of the insert 700 lifts and pads the underside of the tip of the finger where the bowler applies pressure to the bowling ball through the device for improved control. The collar 710 cushions and protects the finger from wearing on the rear edge 712 of the sheath 718.

The full-length insert 700 could be fully cylindrical and formed into longitudinally continuous sections by serrations, but the sectioned-cylindrical shape it is preferred so that the placement of the finger in the sheath 718 is enhanced as described above.

Although the present invention has been described with a certain degree of particularity, it is understood that the present disclosure has been made by way of example, and changes in detail or structure may be made without departing from the spirit of the invention, as defined in the appended claims.

What is claimed is:

1. A bowling aid for placement on a finger of a bowler's hand for enhancing a bowler's control of a bowling ball, said bowling ball having a spherical outer surface, said bowling aid comprising:

a tubular sheath portion having opposite open ends defining a through bore sized to snugly receive a bowler's finger through either of said open ends;

a first plate portion attached to said tubular portion and extending beyond one of said open ends having a spherical underside surface for contacting said spherical outer surface of said bowling ball, said plate portion having an upper surface for contacting at least a portion of a metacarpal joint of a bowlers finger when said bowler's finger extends into said one of said open ends of said tubular portion, said plate portion extends under at least a portion of said tubular portion adjacent said one open end, wherein said plate portion further comprises a first lateral extension portion extending laterally to said tubular portion so as to underlie at least a portion of another metacarpal joint of a bowlers hand when said bowler's finger is positioned into said one open end.

2. The bowling aid according to claim 1 wherein said plate portion and said tubular portion together has a general L shape.

3. The bowling aid according to claim 1 wherein said plate portion further comprises a second lateral extension portion extending in an opposite direction from said first lateral extension portion.

4. The bowler's aid according to claim 1 further comprising a second plate portion extending beyond the other of said open ends having a spherical underside surface for contacting said spherical outer surface of said bowling ball, said second plate portion having an upper surface for contacting at least a portion of a metacarpal joint of a bowlers finger when said bowler's finger extends into said other of said open ends of said tubular portion.

5. The bowler's aid according to claim 4 wherein said second plate portion is thicker than said first plate portion.

6. The bowler's aid according to claim 4 wherein said second plate portion is larger than said first plate portion.

7. The bowler's aid according to claim 6 wherein said larger plate portion has a lateral extension to underlie another metacarpal joint of said bowler's hand when said bowler's finger extends into the open end of said tubular portion over said larger plate portion.

8. The bowler's aid according to claim 4 wherein said first and second plate portions are symmetrical.

9. A bowling aid for placement on a finger of a bowler's hand for enhancing a bowler's control of a bowling ball, said bowling ball having a spherical outer surface, said bowling aid comprising:

a tubular sheath portion having opposite open ends defining a through bore sized to snugly receive a bowler's finger through either of said open ends;

a first plate portion extending beyond one of said open ends having a spherical underside surface for contacting said spherical outer surface of said bowling ball, said plate portion extending under at least a portion of said tubular portion adjacent said one open end, said plate portion having an upper surface for contacting at least a portion of a metacarpal joint of a bowler's finger when said bowler's finger is fully inserted into said one of said open ends of said tubular portion, wherein said first plate portion is laterally symmetrical to a central axis through said tubular portion, and wherein said first plate portion further comprises a first lateral extension portion extending laterally to said tubular portion so as to underlie at least a portion of another metacarpal joint of a bowlers hand when said bowler's finger is positioned into said one open end.

10. The bowling aid according to claim 9 wherein said first plate portion and said tubular portion together has a general L shape.

11. The bowling aid according to claim 9 wherein said first plate portion further comprises a second lateral extension portion extending in an opposite direction from said first lateral extension portion.

12. The bowler's aid according to claim 9 further comprising a second plate portion extending beyond the other of said open ends having a spherical underside surface for contacting said spherical outer surface of said bowling ball, said second plate portion having an upper surface for contacting at least a portion of a metacarpal joint of a bowlers finger when said bowler's finger extends into said other of said open ends of said tubular portion.

13. The bowler's aid according to claim 12 wherein said second plate portion is thicker than said first plate portion.

14. The bowler's aid according to claim 12 wherein said second plate portion is larger than said first plate portion.

15. The bowler's aid according to claim 14 wherein said larger plate portion has a lateral extension to underlie another metacarpal joint of said bowler's hand when said bowler's finger extends into the open end of said tubular portion over said larger plate portion.

16. A bowling aid for placement on a finger of a bowler's hand for enhancing a bowler's control of a bowling ball, said bowling ball having a spherical outer surface, said bowling aid comprising:

a tubular sheath portion having a central axis and having opposite open ends defining a through bore sized to snugly receive a bowler's finger through either of said open ends;

a first plate portion extending beyond one of said open ends having a spherical underside surface for contacting said spherical outer surface of said bowling ball, said plate portion extending under at least a portion of said tubular portion adjacent said one open end, said first plate portion having an upper surface for contacting at least a portion of a metacarpal joint of a bowler's finger when said bowler's finger is fully inserted into said one of said open ends of said tubular portion; and a second plate portion laterally symmetrical about said central axis through said tubular portion, said second plate portion extending beyond the other of said open ends and having a spherical underside surface for contacting said spherical outer surface of said bowling ball, said second plate portion having an upper surface for contacting at least a portion of a metacarpal joint of a bowlers finger when said bowler's finger extends into said other of said open ends of said tubular portion.

17. A bowling aid for placement on a finger of a bowler's hand for enhancing a bowler's control of a bowling ball, a bowling ball having a spherical outer surface, said bowling aid comprising:

a first sheath having a length and defining a bore receiving a bowler's finger, the sheath defining a continuous gap along its length;

a plate attached to a free end of said sheath and extending outwardly from said sheath, said sheath and said plate having a lower surface shaped to engage an outer surface of a bowling ball when pressed against the ball by the bowler's finger; and a fastener attached to said sheath for clamping said sheath on the bowler's finger.

18. A bowling aid as in claim 17, further comprising a second continuous gap formed along the length of the sheath.

19. A bowling aid for placement on a bowler's finger, the finger having a width, for enhancing a bowler's control of a bowling ball having a spherical outer surface, said bowling aid comprising:

a first sheath having a length and defining a bore adapted for snugly receiving a bowler's finger, said sheath having opposing ends and a bottom surface substantially wider than the width of a bowler's finger, and defining a partially spherical concave shape to engage the outer surface of a bowling ball, the sheath defining a continuous gap along its length;

a plate attached to and extending outwardly from one of said opposing ends of said sheath, said plate having a bottom surface wider than the bottom surface of said sheath, and being integrally formed with said bottom surface of said sheath, said bottom surface of said plate shaped to engage the outer surface of a bowling ball; and a fastener attached to said sheath for clamping said sheath on the bowler's finger.

20. A bowling aid as in claim 19, further comprising a second continuous gap formed along the length of the sheath.

21. A bowling aid for placement on a finger of a bowler's hand for enhancing a bowler's control of a bowling ball, the bowling ball having a spherical outer surface, said bowling aid comprising:

a sheath, defining a length, for supportively receiving a bowler's finger, the sheath defining a continuous gap along the length, and a second continuous gap formed along the length of the sheath; and a plate attached to a free end of said sheath and extending outwardly from said sheath, said sheath and said plate having a bottom surface shaped to engage an outer surface of a bowling ball; and a fastener attached to said sheath for clamping said sheath on the bowler's finger.

22. A bowling aid for placement on a finger of a bowler's hand for enhancing a bowler's control of a bowling ball, the bowling ball having a spherical outer surface, said bowling aid comprising:

a sheath defining a length and having a first and second opposing ends and defining a bore for snugly receiving a bowler's finger, the sheath defining a continuous gap along its length;

a plate attached to one of said first or second ends of said sheath and extending outwardly from said sheath, said sheath and said plate having a lower surface shaped to engage an outer surface of a bowling ball; and a fastener attached to said sheath for clamping said sheath on the bowler's finger.

23. A bowling aid as in claim 22, further comprising a second continuous gap formed along the length of the sheath.

24. A full finger insert for positioning a finger in a bowling aid, the insert comprising a tubular main body having a length and defining a plurality of longitudinally oriented sections separated by serrations formed in said main body, said sections being separable from said main body by tearing along the serrations, so that at least one of said sections can be removed from said main body to accommodate a differently sized finger.

25. A full finger insert as defined in claim 24, wherein:

said tubular main body has a top half adjacent to a knuckle side of the finger, and a bottom half adjacent to a pad side of the finger, wherein said tubular main body has a front portion formed from the bottom half of the tubular main body, a rear portion formed from the top half of the tubular main body, and a middle portion formed from the top half and bottom half of the tubular main body to transition between said front and rear portions.

26. A full finger insert as defined in claim 25, wherein said middle portion is sloped.

27. A bowling aid for placement on a finger of a bowler's hand for enhancing a bowler's control of a bowling ball, said bowling ball having a spherical outer surface, said bowling aid comprising:

a tubular sheath portion having opposite open ends defining a through bore sized to snugly receive a bowler's finger through either of said open ends;

a first plate portion extending beyond one of said open ends having a spherical underside surface for contacting said spherical outer surface of said bowling ball; and a full finger insert for positioning in the through bore, the insert including a tubular main body having a length and defining a plurality of longitudinally oriented sections separated by serrations formed in said main body, said sections being separable from said main body by tearing along the serrations.

* * * * *